United States Patent [19]

Reed

[11] Patent Number: 4,732,235

[45] Date of Patent: Mar. 22, 1988

[54] SCAFFOLDING

[76] Inventor: Henry T. Reed, 1 Otterburn Villas South, Jesmond, Newcastle-upon-Tyne, NE2 3AQ, Great Britain

[21] Appl. No.: 758,674

[22] PCT Filed: Nov. 9, 1984

[86] PCT No.: PCT/GB84/00388

§ 371 Date: Aug. 20, 1985

§ 102(e) Date: Aug. 20, 1985

[87] PCT Pub. No.: WO85/02219

PCT Pub. Date: May 23, 1985

[51] Int. Cl.[4] ..... E04G 3/10; E04G 7/04

[52] U.S. Cl. ..... 182/142; 182/152

[58] Field of Search ..... 182/150, 152, 142, 115, 182/156, 178, 196–199, 144, 36

[56] References Cited

U.S. PATENT DOCUMENTS

| | | | |
|---|---|---|---|
| 79,399 | 6/1868 | Rowan | 182/36 |
| 312,354 | 2/1885 | Ivester | 182/199 |
| 396,552 | 1/1889 | Elsbury | 182/195 |
| 3,429,399 | 2/1969 | Kruth | 182/196 |
| 3,900,080 | 8/1975 | Rea | 182/36 |
| 3,951,232 | 4/1976 | Okada | 182/142 |
| 4,068,738 | 1/1978 | Reed | 182/150 |
| 4,253,549 | 3/1981 | Petren | 182/150 |
| 4,388,982 | 6/1983 | Yonahara | 182/150 |

FOREIGN PATENT DOCUMENTS

| | | |
|---|---|---|
| 2551594 | 5/1976 | Fed. Rep. of Germany . |
| 1340487 | 12/1973 | United Kingdom . |

*Primary Examiner*—Reinaldo P. Machado

*Attorney, Agent, or Firm*—McAulay, Fields, Fisher, Goldstein & Nissen

[57] ABSTRACT

Collapsible scaffolding comprises a number of platforms which can be suspended in spaced vertical array for chains secured to the corners of the platform, and arranged at the top for the support of the scaffolding by a crane or a horizontally movable trolley. Additional cables at each end of the platforms are each secured at the lower end to the lowest platform and pass through guides secured to the intermediate and top platforms to a winch enabling the platform to be quickly lifted and stacked but allowing them to be quickly lowered and erected. The guides provide lateral location of the stacked platforms.

8 Claims, 9 Drawing Figures

SCAFFOLDING

This invention relates to scaffolding which can be easily erected and removed even though it may extend over a substantial height of a surface to be worked on.

One example of such scaffolding is the subject of British Patent Specification No. 1340487 in which is described a collapsible assembly consisting of a number of platforms in combination with flexible chains for suspending them in a vertical array one spaced from another while allowing them to be collapsed on one another in a stack for storage or transport. In a preferred arrangement there are four vertical chains secured at the corners of identical rectangular platforms so that by lifting the top platform by a crane, the platforms in the stack can be separated from one another and lifted and moved to the required location perhaps at the side of the hull of a ship where they can be secured in position.

When the scaffolding was no longer to be used in that position, it could be collapsed again by being suspended from a crane while the connections to the vertical surface were removed, and then lowered to the ground so that the platforms collapsed one on another. That was quite satisfactory in a dock but for use in some circumstances, for example while working at sea on an oil rig where the weather may change abruptly, it is considered important to be able to lift the lower platforms very quickly and an object of the present invention is to provide scaffolding which enables that to be done.

According to the present invention, scaffolding comprises a number of platforms and flexible chains or equivalent suspension means for suspending them in a vertical array, one spaced from another, while allowing them to be collapsed on one another in a stack for storage or transport, and includes at least one additional cable secured to the lowest platform and capable of sliding—preferably in guided relation—to the other platforms by winding in, so that the lowest platform secured to the additional cable or cables can be lifted and stacked against the platform above it, and by further winding in those platforms can be lifted against the next lowest platform and so on.

A winch may be included at the top of each additional cable. perhaps on the top platform. but whether such a winch is used or an external winch, it will be clear that at least the lowest platforms can be very quickly raised merely by winching in if for example the sea becomes very rough quickly. It is only necessary for people on the lowest platforms to climb up to higher platforms before winching can commence. In general there will be no necessity to release any connections.

In a preferred form of the invention there are two additional cables one at the middle of each end of the platform, which are rectangular.

The additional cable or cables can pass through guide sleeves on the various intermediate platforms so that they cannot move laterally in relation to the platforms but can move easily vertically when the lowest platforms are to be winched in or lowered. Such guide sleeves conveniently have conical or other lead-in portions so that an end of a guide sleeve on one platform can be located in and held located in the other end of a guide sleeve on the next platform to prevent lateral movement of the platforms in relation to each other when they are stacked.

In general the platforms will be secured against movement in relation to the length of the flexible chains or suspension means, of which there might be three or preferably four, one at each corner of each platform, but those chains can just collapse onto the platforms or at the edges of the platforms as platforms are raised in relation to the ones above them.

Each platform may have a manhole associated with a ladder so that workers can move up or down between platforms and in a preferred arrangement a ladder is pivoted at the top adjacent a manhole in an upper platform and can fall freely at its lower end against the lower platform where there may be a roller at that lower end of the ladder so that the ladders can be collapsed at the underside of an upper platform or dropped into a working position automatically as the platforms are raised or lowered.

Safety rails for each of the platforms can be merely secured to the flexible chains so that they collapse with the chains when platforms are raised, and it is not necessary to have any additional assembling and dis-assembling steps before or after scaffolding is used.

At the top the suspension means may be provided with shackles either for securing to fittings on the construction where the scaffolding is to be erected, or for support on hooks of a crane or possibly also on a trolley or the equivalent capable of horizontal movement along a rail so that the complete set of scaffolding can be moved horizontally when necessary whether in the dropped, stacked, or partly-dropped, state.

The invention may be carried into practice in various ways and one embodiment will now be described by way of example, with reference to the accompanying drawings in which.

Figure 7:
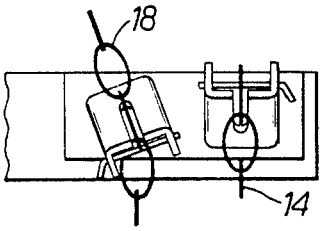
Figure 8:
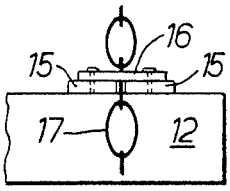
Figure 9:
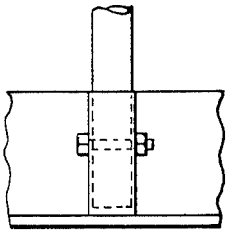

FIGS. 7, 8, and 9 are sketches of details of chain connections.

Figure 4:
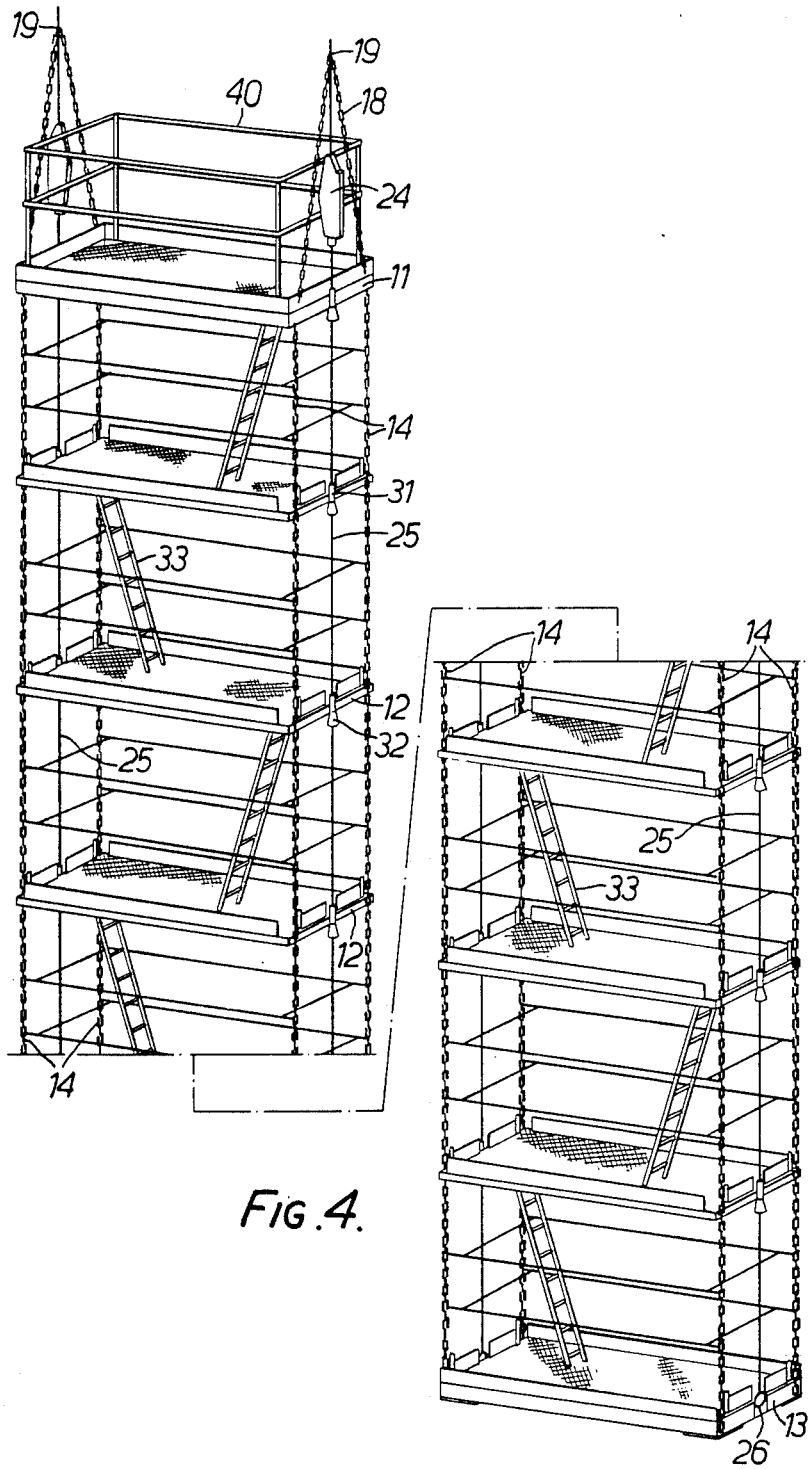

In the example being described the scaffolding comprises nine platforms including a top platform 11, seven intermediate platforms 12, and a bottom platform 13. They are arranged to be suspended one above the other as shown in FIG. 4 by means of four vertical chains 14 one at each corner of all the platforms which are vertically in line with each other, and spaced apart by more than the height of a man. That arrangement is generally as described in British Patent Specification No. 1340487 and it will suffice here to say that each chain 14 is connected at the corresponding corner to each of the platforms 11—13 in such a way that a platform cannot move vertically in relation to the chains it is secured to. The connection for an intermediate platform 12 is as shown in FIG. 8 where two closely spaced horizontal plates 15 can be seen one on either side of one link in the chain, while they are connected together by an upper transverse plate 16. Suspension is from the chain and the platform is seated on a lower link shown at 17 in FIG. 8 where the undersides of the plates 15 embrace the link above that.

For the top platform 11, the chain 14 is secured at the corner in a somewhat similar manner, but there is an additional chain 18 extending to a position above the mid-point of the end of the platform where it meets the corresponding chain from the other corner of that end of the platform to form one of two suspension points 19 from which the weight of the complete set of staging can be suspended.

Figure 5:
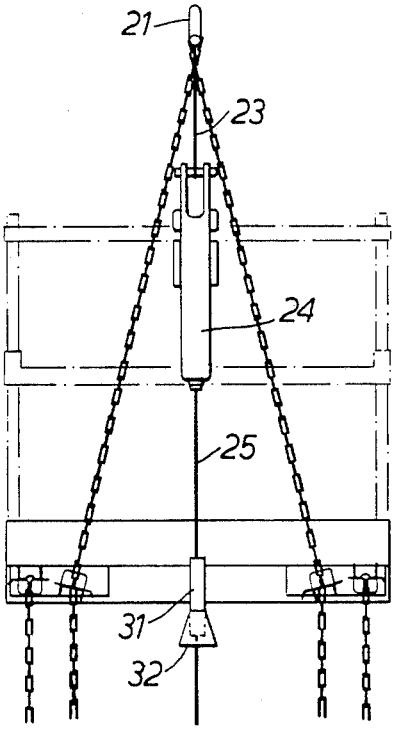
FIG. 5 is an end view to an increased scale of the top platform.
Figure 6:
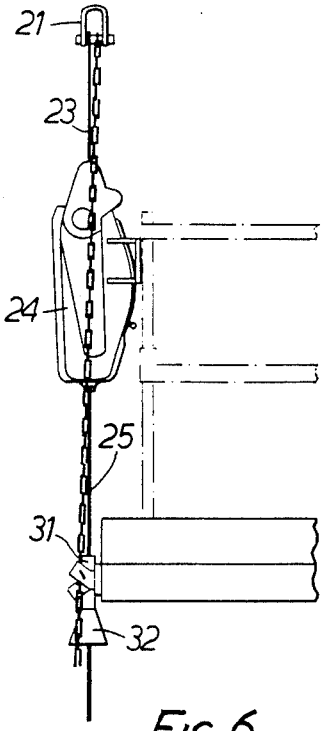
FIG. 6 is a side view of the end of the top platform.

The two suspension points could be supported from a crane or from shackles as shown at 21 in FIG. 5 and FIG. 6 which may be secured to fixed points, or may be secured to a carriage capable of running on a continuous horizontal runway beam to enable the scaffolding to be moved horizontally whether in a straight or a curved path.

Also suspended from each of the shackles 21 by a cable 23 is a winch 24 which could be a manual winch or a hydraulic, pneumatic, or other, type of powered winch.

A cable 25 depends from the winch 24 and extends down outside the ends of all the platforms to the bottom platform where it is secured at 26. The cable 25 passes through a guide secured at the middle of the end of each platform. It is in the form of a cylindrical tube 31 above a conical member 32 which can accommodate the upper end of the tube 31 of the lower platform when two platforms are collapsed one on the other.

Figure 1:
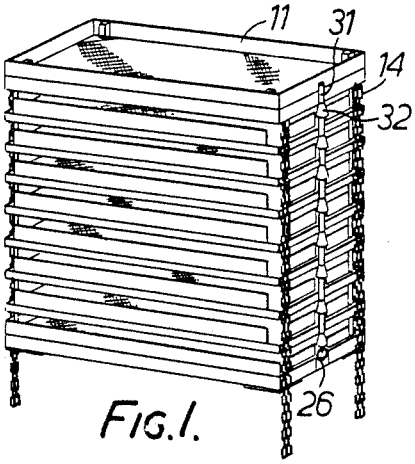
FIGS. 1, 2, 3 and 4 are perspective views of multi platform staging respectively during transport to site, during suspension at site; while being positioned; and in the final position.

That is how they are seen in FIG. 1 with the scaffolding collapsed for storage and for transport to site. The chains 14 between successive platforms are collapsed and the winch cables 25 are wound in. The chains 18 and suspension points and shackles 21 are collapsed in the middle of the top platform 11. The assembly is lifted by a crane at the suspension points 19 and the shackles 21 are secured to the desired fixing positions or the trolley on the horizontal rail if such is to be used.

Figure 3:
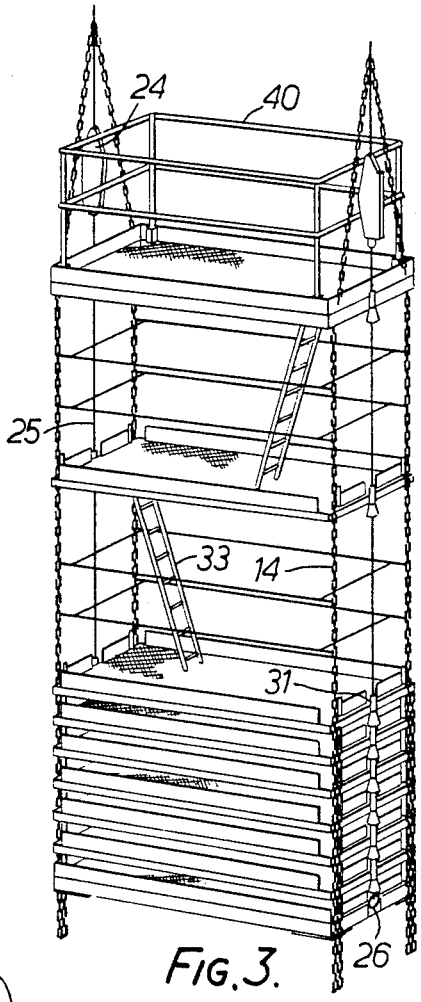
Figure 2:
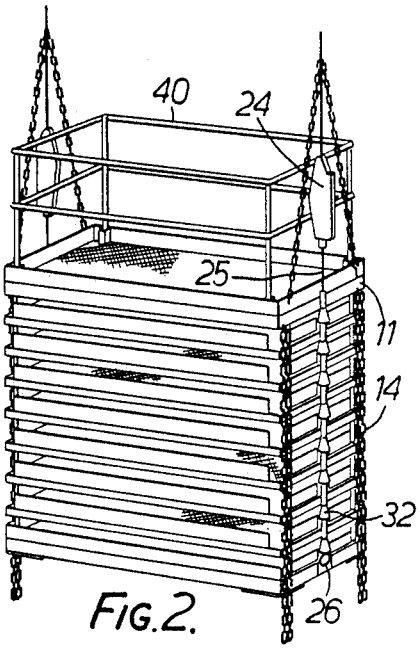

Then the winches 25 are operated to pay out the cable 25 equally at both ends, so that with the top platform 11 suspended at the correct height, the lower platforms are lowered from it with them all resting on the bottom platform 13 until the chains supporting the second platform from the top are fully extended when the remaining platforms continue to drop as the winches pay out more cable. FIG. 3 shows the situation when the third platform from the top has reached its final position with the suspension cables 14 hanging vertically.

Eventually all the platforms reach their final positions as shown in FIG. 4, and it has been found that if the surface against which the scaffolding is assembled is a vertical surface, it is not necessary to secure the bottom platform or any of the intermediate platforms against that surface, because the scaffolding remains stably in position under its own weight.

Between each pair of platforms 12 are two horizontal rings of guard rails 31 which are secured at their ends to the suspension chains 14 so that they move into the correct position automatically during lowering. The guard rails 31 can have manually removable pivotal connections so that if need be someone on a platform can have access to an adjacent horizontal surface.

Each platform has a manhole at a position as indicated generally at 32 in FIG. 4, from which is pivotally supported a ladder 33 leading down to the next platform. That ladder has a nylon horizontal roller at the bottom so that during lowering the ladder drops and rolls into the correct position automatically while it can be automatically folded up against the bottom of the platform supporting it during lifting. When the chains 14 are straight the ladder is at the correct angle for safety.

It is necessary to provide a separate guard rail arrangement 40 around the top platform because there are no vertically extending suspension chains such as 14 from which it can be supported. The components of such a guard rail assembly can be carried on the top platform 11 when it is in the stacked state of FIG. 1, and then erected by hand, but apart from that it will be appreciated that lowering the platforms from the top platform and lifting them again, can be done without making or breaking any connections, but merely by operation of the winches 24. The conical guides 32 ensure that as lower platforms are lifted they engage correctly in lateral relationship to the platforms above them, and are then retained in that lateral location when stacked, as shown in FIG. 1, so that the stack is stable.

In one embodiment it has been found possible to lift all the lower platforms up to the bottom of the upper platform 11 in no more than twenty minutes which is quite fast enough for most applications. Of course as soon as the weather improves the lower platforms can be lowered again just as easily.

It may be noted that although the suspension chains 14 at the top have to be strong enough to carry the full weight of all the platforms below them, the winching additional cables 25 have to be strong enough to carry not only the bottom platform 13 to which they are attached at 26, but all the platforms above that bottom platform and the ladders and suspension chains as they become stacked on the bottom platform during lifting as shown in FIG. 3. The bottom platform is strengthened for that purpose.

One scaffolding assembly has been designed to give access to a vertical surface over a height of 140 feet and that assembly includes 21 platforms with a spacing of seven feet between successive platforms.

I claim:

1. Scaffolding comprising: an assembly of platforms; a number of horizontally-spaced flexible suspension means secured at spaced positions along their length to the platforms for suspending the platforms in vertical array, one spaced from another while allowing them to be collapsed on one another in a stack; hoisting means secured to the lowest platform and capable of sliding in relation to the other platforms; winch means for winching in the hoisting means to lift and stack the lowest platform against a platform above it and then to raise all the lower platforms up to the top platform; and guides mounted on each platform with each guide having an end which can be guided into a lead-in portion of an adjacent guide so that as platforms are stacked together they are laterally located in relation to each other by the guides.

2. Scaffolding as claimed in claim 1 in which the hoisting means comprise a number of cables, each of which can slide in the guides secured to the platforms above the lowest platform.

3. Scaffolding comprising an assembly of platforms and a number of horizontally-spaced flexible suspension means secured at spaced positions along their length to the platforms for suspending the platforms in vertical array, one spaced from another while allowing them to be collapsed on one another in a stack, said scaffolding including hoisting means comprised of a number of cables secured at the edge of the lowest platform and passing outside the ends of all the other platforms and capable of sliding in relation to the other platforms; winch means for winching in the hoisting means to lift and stack the lowest platform against a platform above it and then to raise all the lower platforms up to the top platform; and guides mounted on each platform, each guide having an end which can be guided into a lead-in portion of an adjacent guide so that as platforms are stacked together they are laterally located in relation to each other by the guides; the hoisting cables being slideable in the guides secured to the ends of the platforms above the lowest platform.

4. Scaffolding as claimed in claim 3 in which there is mounted on the top platform a winch for each cable.

5. Scaffolding comprising an assembly of platforms and a number of horizontally-spaced flexible suspension means secured at spaced positions along their length to the platforms for suspending the platforms in vertical array one spaced from another while allowing them to be collapsed on one another in a stack, and including a plurality of hoisting cables secured to the lowest platform and capable of sliding in relation to the other platforms so that the lowest platform can be lifted and stacked against a platform above it by winding in the cable, a winch for each of the hoisting cables arranged to winch in said hoisting cables to raise all the lower platforms up to the top platform, and platform guides mounted on each platform with each guide having an end which can be guided into a lead-in portion of an adjacent guide so that as platforms are stacked together they are laterally located in relation to each other by the guides.

6. Scaffolding as claimed in claim 5 in which the hoisting cables can slide in cable guides secured at the edges of the platforms above the lowest platform.

7. Scaffolding as claimed in claim 5 in which the platform guides include guides for the hoisting cables.

8. Scaffolding comprising a horizontal rail; a trolley mounted for movement along the rail; an assembly of platforms and a number of horizontally-spaced flexible suspension means secured at spaced positions along their length to the platforms for suspending the platforms from the trolley in vertical array, one spaced from another while allowing them to be collapsed on one another in a stack; hoisting means secured at the edge of the lowest platform and capable of sliding in relation to the other platforms, winch means for winching in the hoisting means to lift and stack the lowest platform against a platform above it and then to raise all the lower platforms up to the top platform; and shackles for supporting the hoisting means from the trolley; said winch means being secured to said shackles.

* * * * *